US007107723B2

(12) United States Patent
Chiang

(10) Patent No.: US 7,107,723 B2
(45) **Date of Patent: *Sep. 19, 2006**

(54) ADJUSTABLE AUTOMATIC POSITIONING HINGE FOR GLASS DOORS

(76) Inventor: Fanny Chiang, 11 Fl.-4, No. 16, Chungming S. Rd., West Dist., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/065,580

(22) Filed: Feb. 25, 2005

(65) Prior Publication Data

US 2005/0144757 A1 Jul. 7, 2005

Related U.S. Application Data

(63) Continuation-in-part of application No. 10/843,567, filed on May 12, 2004, now Pat. No. 6,966,150, which is a continuation-in-part of application No. 10/411,231, filed on Apr. 11, 2003, now Pat. No. 6,826,870.

(51) Int. Cl.
*E05D 7/08* (2006.01)

(52) U.S. Cl. ..... 49/388

(58) Field of Classification Search ..... 49/388, 49/397, 399; 16/252, 334, 335; 52/204.58, 52/204.53, 204.54, 204.62, 204.65, 656.2, 52/656.4, 235, 656.9, 213
See application file for complete search history.

(56) References Cited

U.S. PATENT DOCUMENTS 6,519,811 B1 * 2/2003 Cheng ..... 16/252
6,826,870 B1 * 12/2004 Chiang ..... 49/388
6,966,150 B1 * 11/2005 Chiang ..... 49/388

* cited by examiner

*Primary Examiner*—Jerry Redman
(74) *Attorney, Agent, or Firm*—Fei-Fei Chao; Andrews Kurth LLP

(57) ABSTRACT

An adjustable automatic positioning hinge for a glass door includes a doorframe mount, a body, a spindle, a positioning device, a door bracket and at least one pair of adjusting screws. The body is attached to the doorframe mount and rotatably holds the spindle. The spindle has an exterior surface and at least one adjusting flat defined in the exterior surface. The positioning device is mounted in the body to position the spindle. The door bracket holds the spindle and clamps a glass panel. The adjusting screws are mounted in the door bracket and respectively have an inside end abutting a corresponding adjusting flat. Consequently, the adjustable hinge is simple, and small adjustments can be made to align the glass panel with a doorframe of the glass door.

14 Claims, 10 Drawing Sheets

ADJUSTABLE AUTOMATIC POSITIONING HINGE FOR GLASS DOORS

This application is a copending application of U.S. patent application No. 11/028,564, filed on Jan. 5, 2005, and is a continuation-in-part (CIP) application of CIP application Ser. No. 10/843,567, filed on May 12, 2004, and issued as U.S. Pat. No. 6,966,150 on Nov. 22, 2005, which is a CIP application of patent application Ser. No. 10/411,231, filed on Apr. 11, 2003, and issued as U.S. Pat. No. 6,826,870 on Dec. 7, 2004, wherein the content of the copending application and parent applications are herein incorporated by reference.

BACKGROUND OF THE INVENTION

1. Field of the Invention

The present invention relates to automatic positioning hinges for doors, and more particularly to an adjustable automatic positioning hinge for a glass door in a doorway system.

2. Description of Related Art

A glass door in a conventional doorway system comprises a glass panel, a doorframe and two conventional hinges. The glass panel is pivotally mounted in the doorframe with the hinges. However, exact alignment of the glass panel with the doorframe is important for the glass door. The glass door will not close completely when the glass panel is not aligned exactly with the doorframe.

However, accurately installing the glass panel in the doorframe with the conventional hinges is difficult because the glass panel is generally bulky and heavy to increase security and strength. The glass panel may not be exactly aligned with the doorframe, and small adjustments will be needed to align the glass panel exactly with the doorframe. Conventional hinges in accordance with prior art for glass doors are complex to assemble and cannot be adjusted to align the glass panel with the doorframe after the glass panel has been mounted in the doorframe.

Therefore, installing the glass panel in the doorframe with conventional hinges requires talent and experience or repeated assembly, disassembly and reassembly to ensure exact alignment of the glass panel with the doorframe. Installation of the glass door with the conventional hinges is inconvenient, slow and costly.

To overcome the shortcomings, the present invention provides an adjustable automatic positioning hinge for a glass door to mitigate or obviate the aforementioned problems.

SUMMARY OF THE INVENTION

The main objective of the invention is to provide an adjustable automatic positioning hinge for a glass door, which can make small adjustments to align the glass panel with the doorframe.

The adjustable automatic positioning hinge for a glass door has a doorframe mount, a body, a spindle, a positioning device, a door bracket and at least one pair of adjusting screws. The body is securely attached to the doorframe mount and rotatably holds the spindle. The spindle has an exterior surface and at least one adjusting flat defined in the exterior surface. The positioning device is mounted in the body to apply a restitution force to the spindle to return the glass panel to or hold the glass panel in a closed position. The door bracket holds the spindle and clamps onto the glass panel. The adjusting screws are mounted in the door bracket and have inside ends abutting a corresponding adjusting flat. Consequently, the adjustable hinge is simple, and small adjustments can be made to align the glass panel with the doorframe of the glass door by screwing or unscrewing the adjusting screws when the glass panel is not exactly aligned.

Other objects, advantages and novel features of the invention will become more apparent from the following detailed description when taken in conjunction with the accompanying drawings.

DETAILED DESCRIPTION OF PREFERRED EMBODIMENT

Figure 1:
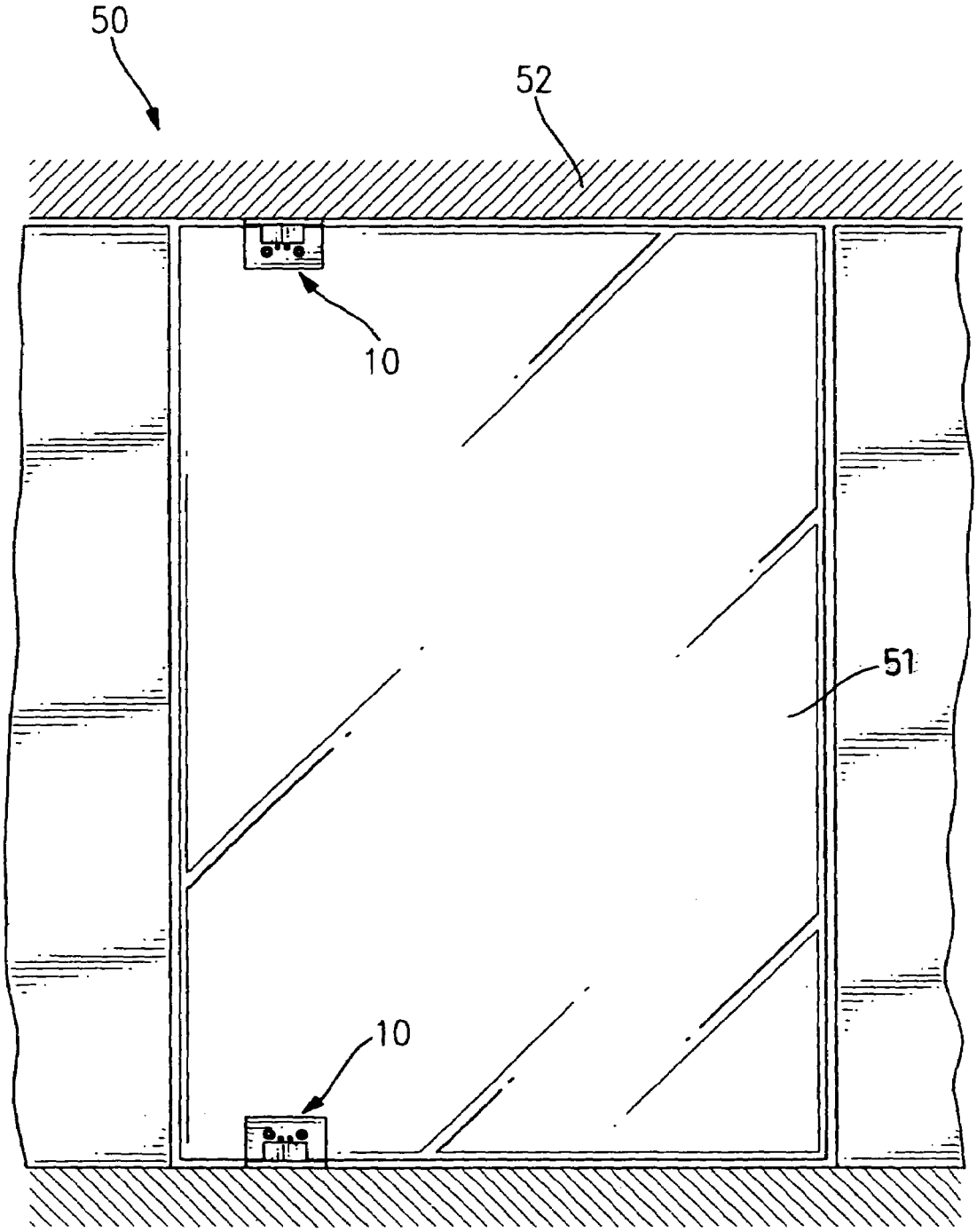
FIG. 1 is a front view of a glass door with a first embodiment of adjustable hinges in accordance with the present invention.
Figure 6:
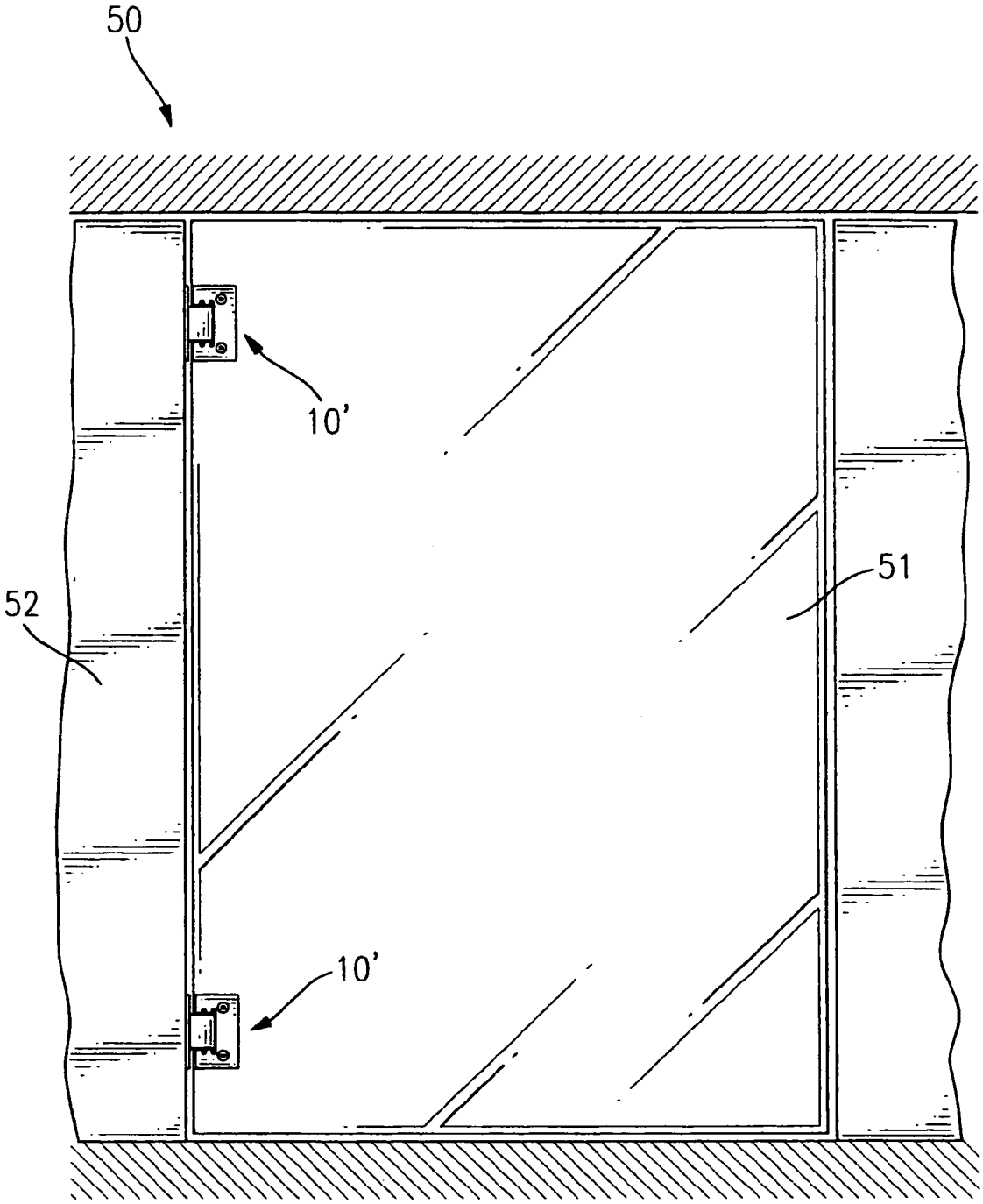
FIG. 6 is a front view of a glass door with a second embodiment of adjustable hinges in accordance with the present invention.

With reference to FIGS. 1 and 6, a glass door (50) includes a glass panel (51) and a doorframe (52) and must have at least two hinges (10, 10') to mount the glass panel (51) pivotally in the doorframe (52). The glass panel (51) has a top edge, a bottom edge, a pivoting edge and a distal edge. The glass panel (5 1) can be installed in the doorframe (52) with the hinges (10, 10') in two configurations. One configuration has the hinges (10) attached respectively to the top and the bottom edges of the glass panel (51) to hold the glass panel (51) pivotally in the doorframe (52). The other configuration has the hinges (10') attached to the pivoting edge of the glass panel (51) to hold the glass panel (51) pivotally in the doorframe (52).

Figure 2:
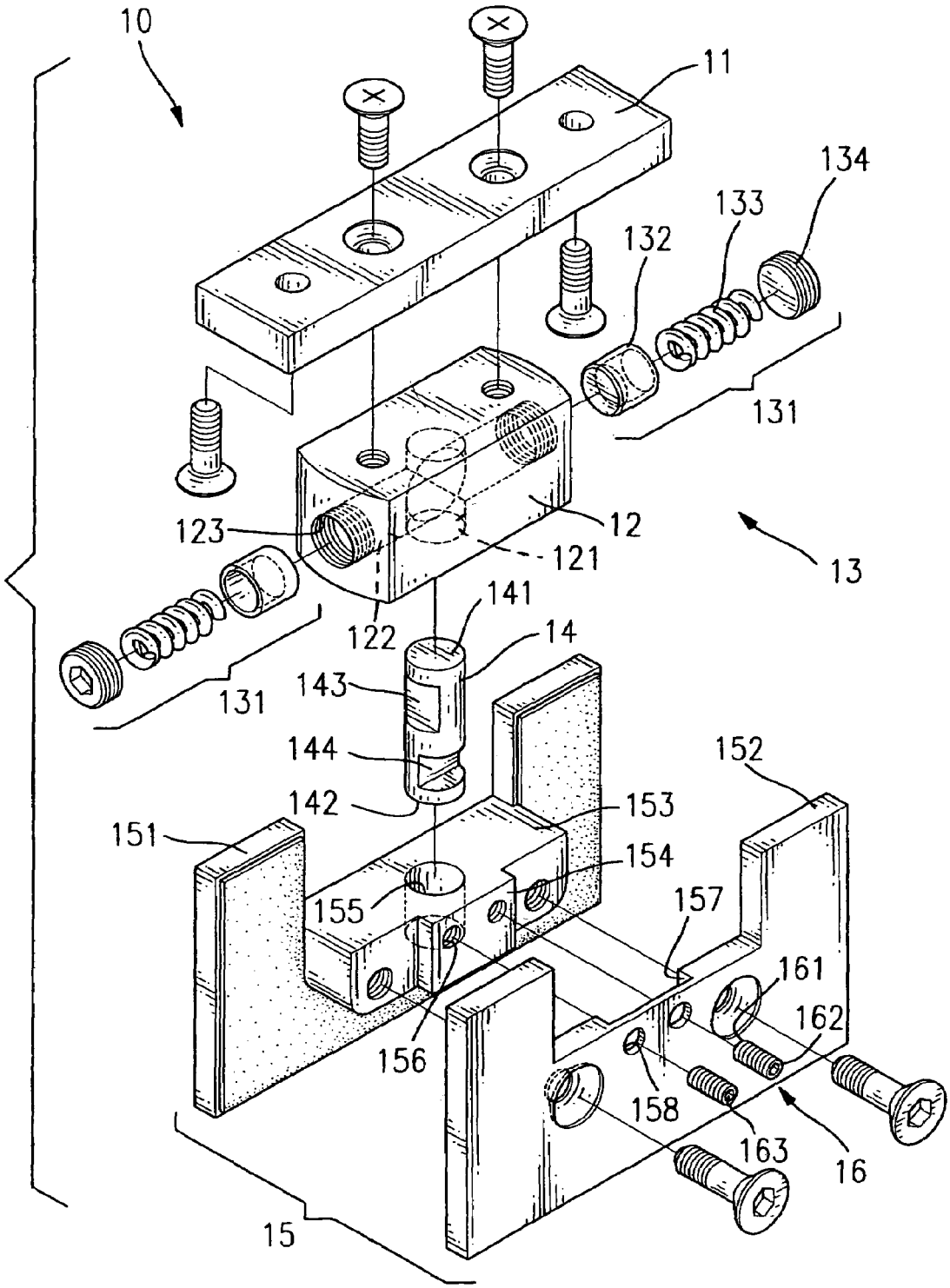
FIG. 2 is an exploded perspective view of an adjustable hinge in FIG. 1.

With reference to FIGS. 1 and 2, a first embodiment of an adjustable hinge (10) in accordance with the present invention mounts a glass panel (51) in a doorframe (52) by attaching the adjustable hinges (10) respectively to the top and bottom edges of the glass panel (51). The first embodiment of the adjustable hinge (10) comprises a doorframe mount (11), a body (12), a spindle (14), a positioning device (13), a door bracket (15) and a pair of adjusting screws (16).

The doorframe mount (11) attaches the adjustable hinge (10) to the doorframe (52) and has multiple fasteners and multiple through holes. The fasteners pass respectively through the through holes and attach the doorframe mount (11) to the door frame (52) and to the adjustable hinge (10).

The body (12) is attached to the doorframe mount (11) and has a spindle positioning hole (121), two transverse holes (122) and two threaded mounting holes. The spindle positioning hole (121) is defined longitudinally in the body (12) and faces the glass panel (51). The transverse holes (122) are defined coaxially in the body (12) and intersect and communicate with the spindle positioning hole (121). Each transverse hole (122) has an outside opening (not numbered) and an interior thread (123) defined in the outside opening. The threaded mounting holes correspond to two through holes in the doorframe mount (11).

Figure 3:
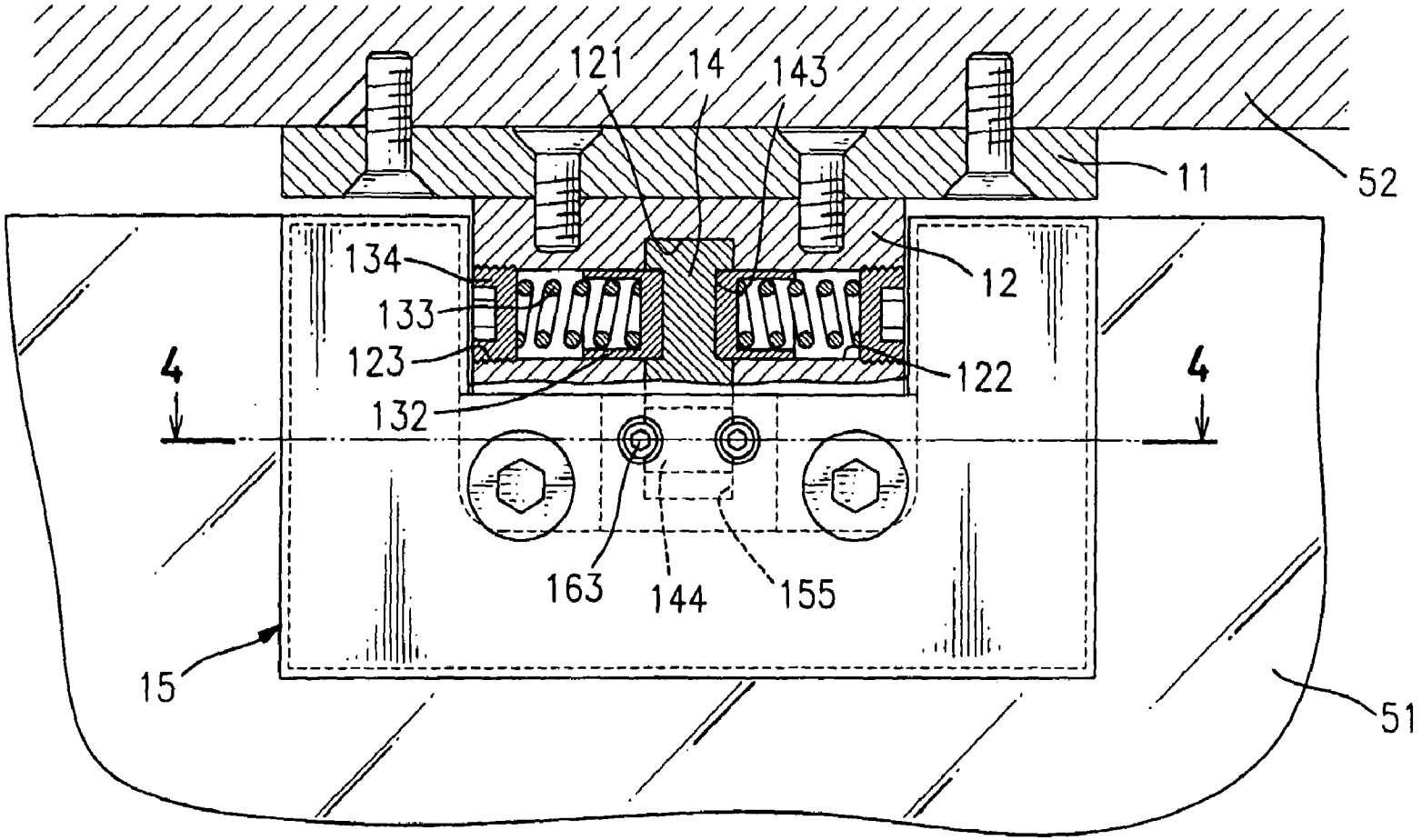
FIG. 3 is an operational front view in partial section of the adjustable hinge in FIG. 2.

With further reference to FIG. 3, the spindle (14) is a cylinder and has an outer end (141), an inner end (142), an exterior surface, two positioning flats (143) and an adjusting flat (144). The outer end (141) is rotatably held in the spindle positioning hole (121) in the body (12). The positioning flats (143) are defined in the exterior surface and align respectively with the transverse holes (122). The adjusting flat (144) is radially defined in the exterior surface of the spindle (14).

The positioning device (13) comprises two activating assemblies (131) that are mounted and held respectively in the transverse holes (122). Each activating assembly (131) comprises a sliding plug (132), a resilient element (133) and a threaded plug (134). The sliding plugs (132) are slidably mounted respectively in the transverse holes (122) and press respectively against the positioning flats (143) on the spindle (14). The resilient element (133) can be a spring, is mounted in the transverse hole (122) and has two opposite ends (not numbered). The threaded plugs (134) screw respectively into the interior threads (123) in the transverse holes (122) and compress the resilient elements (133) against the sliding plugs (132) so the sliding plugs (132) firmly press respectively against the positioning flats (143).

The door bracket (15) securely holds the inner end (142) of the spindle (14), connects to the glass panel (51) and comprises a male bracket (151) and a female bracket (152). The male bracket (151) and the female bracket (152) may be U-shaped and are attached to each other to form the door bracket (15) to hold the glass panel (51).

The male bracket (151) has a primary protrusion (153). The primary protrusion (153) has a secondary protrusion (154), a spindle alignment hole (155) and a pair of threaded adjustment holes (156). The spindle alignment hole (155) is aligned with the spindle positioning hole (121) in the body (12) and rotatably holds the inner end (142) of the spindle (14).

The adjusting flat (144) on the spindle (14) is mounted in the spindle alignment hole (155). The threaded adjustment holes (156) are defined transversely through the primary and secondary protrusions (153, 154), communicate with the spindle alignment hole (155) and are aligned with the adjusting flat (144) on the spindle (14).

The female bracket (152) is attached to the male bracket (151) so the glass panel (51) will be held securely between the two brackets (151, 152). The female bracket (152) has a recess (157) and a pair of through holes (158). The recess (157) faces, holds and engages the secondary protrusion (154) and keeps the two brackets (151, 152) from moving relative to each other. The through holes (158) are aligned respectively with the threaded adjustment holes (156) in the male bracket (151).

The adjusting screws (16) screw respectively into the threaded adjustment holes (156) in the male bracket (151) through the through holes (158) in the female bracket (152). Each of the adjusting screws (16) has an inside end (161) and an outside end (162). Each outside end (162) has a hexagonal driving recess (163) so the adjusting screws (16) can be driven into or retracted from the threaded adjustment holes (156) with an Allen wrench (not shown). The inside ends (161) press against the adjusting flat (144) on the spindle (14).

The glass door (50) is closed and the glass panel (51) is held in a closed position by the sliding plugs (132) pressing respectively against the positioning flats (143). Pulling or pushing the glass panel (51) will open the glass door (50) and will pivot the glass panel (51) and the spindles (14) in the hinges (10). The sliding plugs (132) slide respectively out of full contact with the positioning flats (143) and compress the resilient elements (133). The compressed resilient elements (133) press the sliding plugs (132) that cause the spindle (14) to rotate until the sliding plugs (132) are in full contact with the positioning flats (143) again. When the sliding plugs (132) are in full contact with the positioning flats (143) the glass panel (51) is in the closed position so the positioning device (13) automatically closes the glass panel (51).

Figure 4:
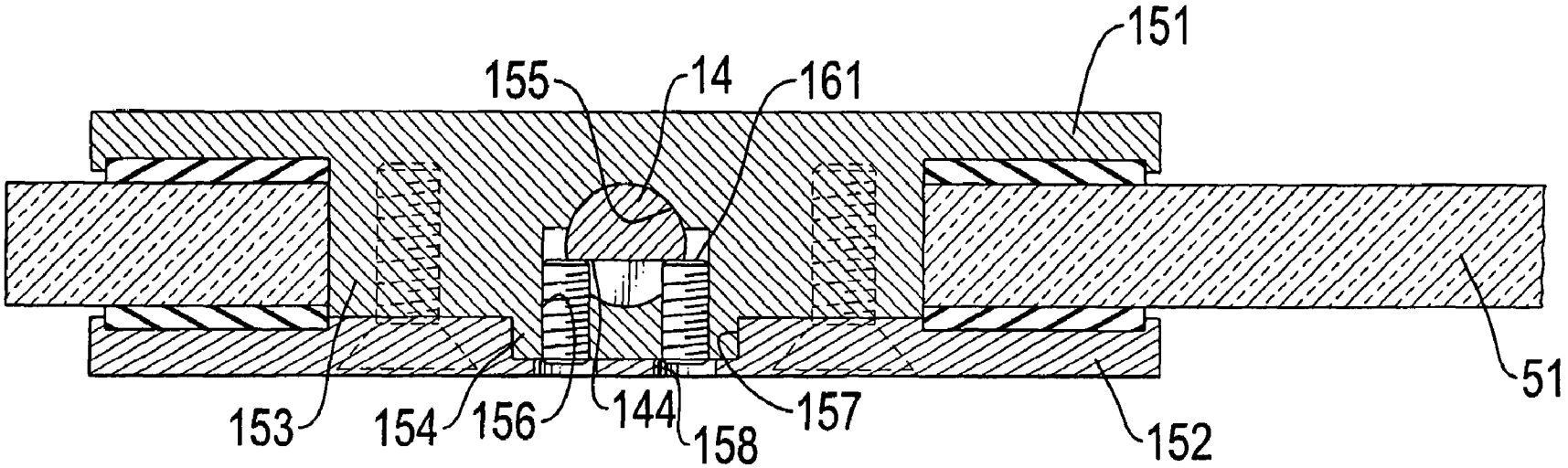
FIG. 4 is a top view in partial section of the adjustable hinge along line 3—3 in FIG. 3.
Figure 5:
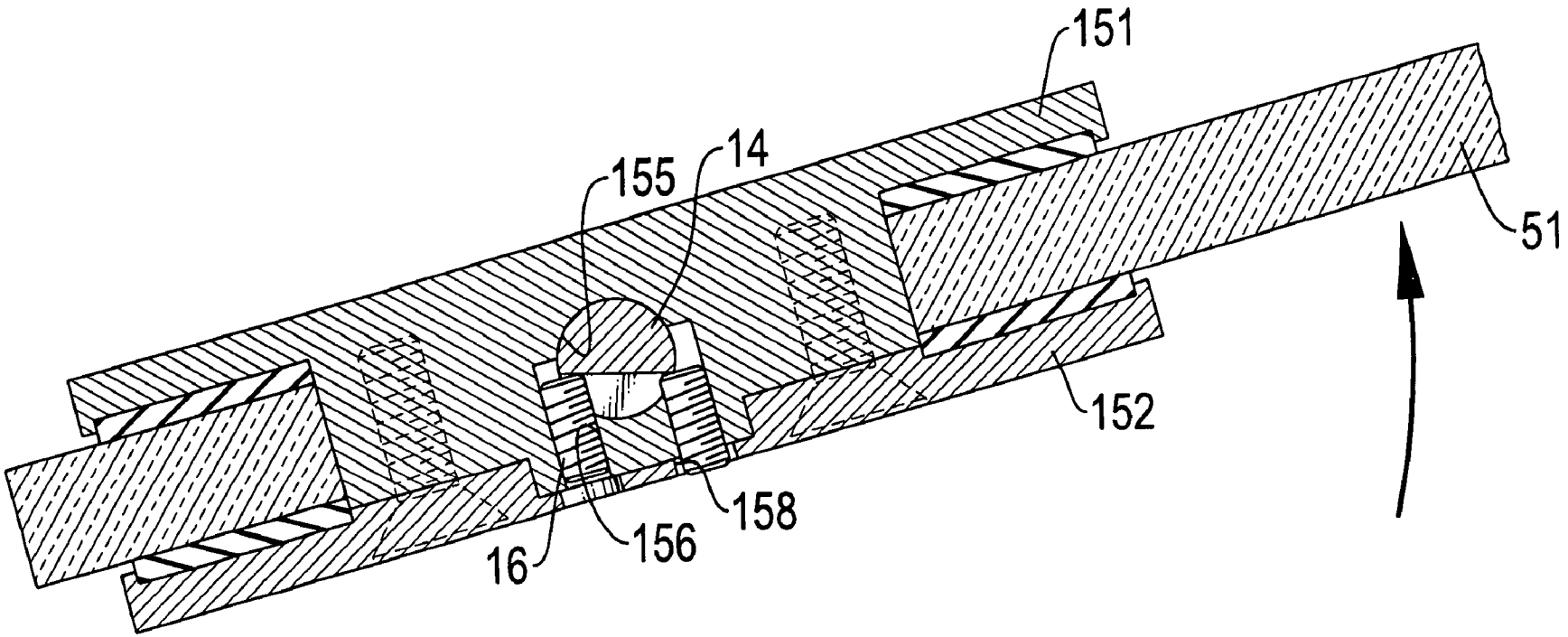
FIG. 5 is an operational top view in partial section of the adjustable hinge in FIG. 4 when a small adjustment is made to the glass panel of a glass door with the adjustable hinge.

With further reference to FIGS. 4 and 5, the adjusting screws (16) change the position of the door bracket (15) and the glass panel (51) relative to the spindle (14) to align the glass panel (51) with the doorframe (52) when the glass panel (51) is askew. Unscrewing one of the adjusting screws (16) from the corresponding threaded adjustment hole (156) and screwing the other adjusting screw (16) into the other threaded adjustment hole (156) causes the inside ends (161) of the adjusting screws (16) abutting the adjusting flat (144) to change the angular position of the door bracket (15) relative to the spindle (14). Accordingly, exact alignment of the glass panel (51) with the doorframe (52) can be accomplished by the adjusting screws (16).

Figure 7:
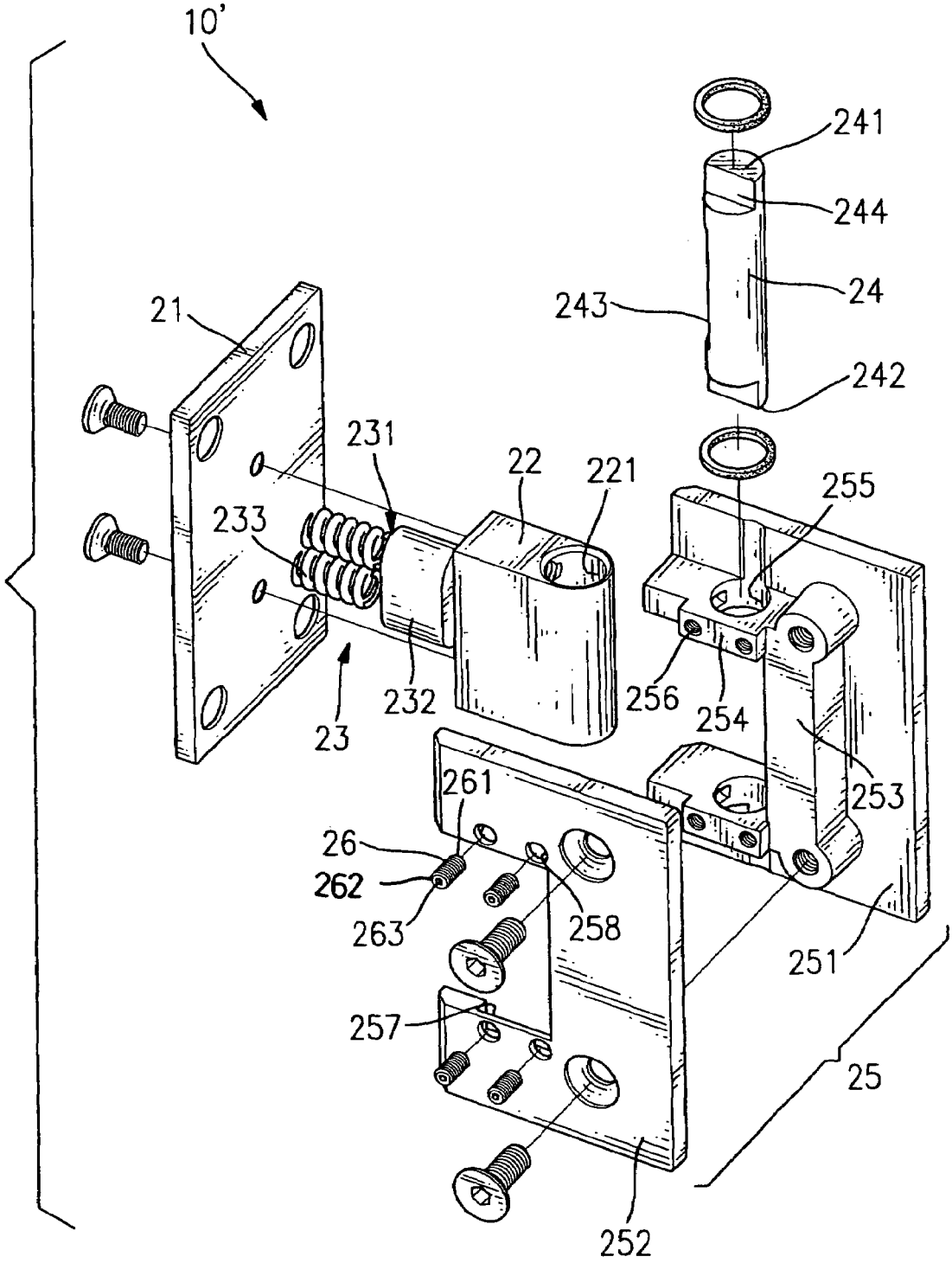
FIG. 7 is an exploded perspective view of one of the adjustable hinges in FIG. 6.

With reference to FIGS. 6 and 7, a second embodiment of an adjusting hinge (10') in accordance with the present invention pivotally attaches a glass panel (51) to a doorframe (52) by attaching two adjusting hinges (10') to the pivoting edge of the glass panel (51) and to the doorframe (52). The hinge (10') comprises a doorframe mount (21), a body (22), a spindle (24), a positioning device (23), a door bracket (25) and two pairs of adjusting screws (26).

Figure 8:
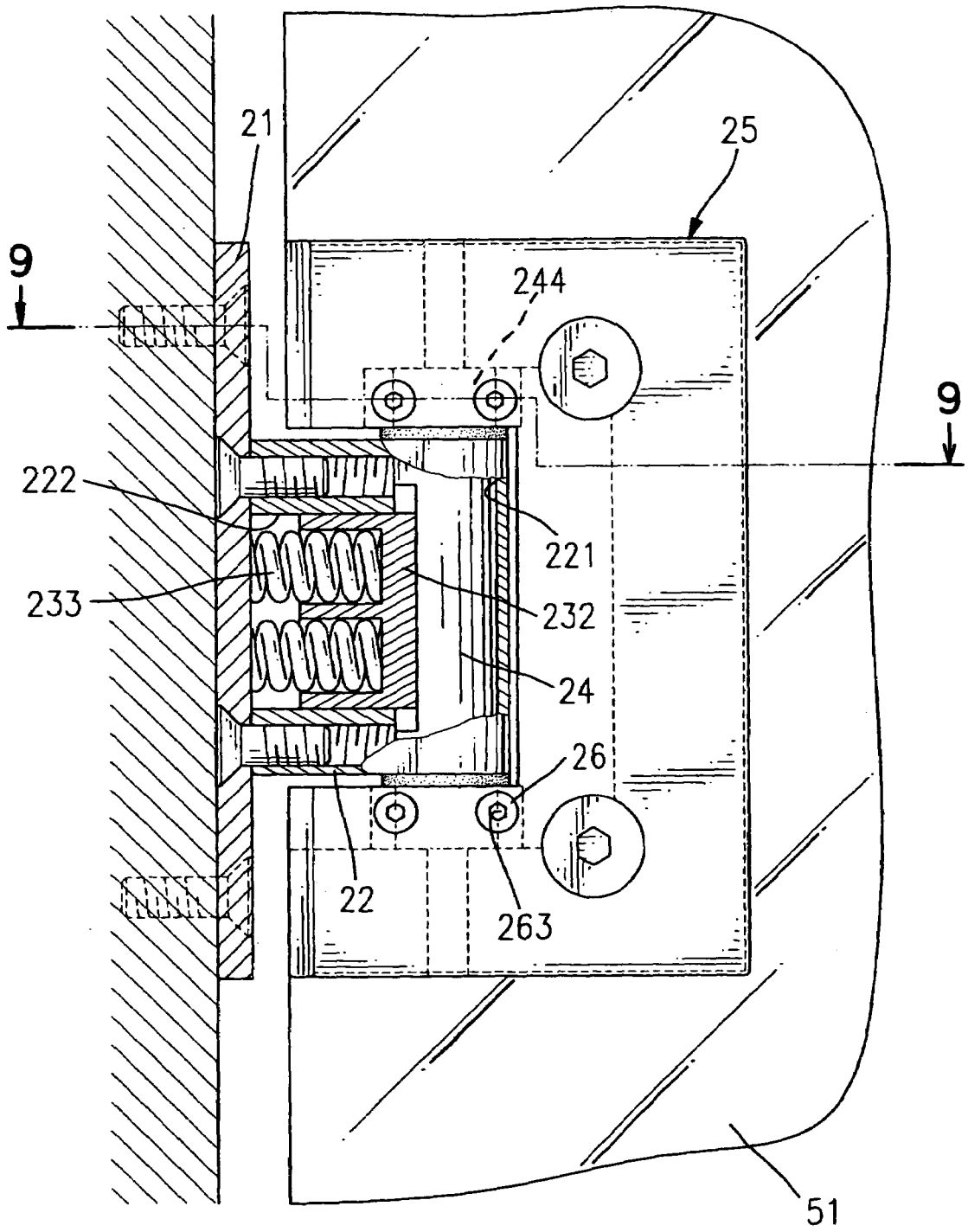
FIG. 8 is an operational front view in partial section of the adjustable hinge in FIG. 7.

With further reference to FIG. 8, the doorframe mount (21) attaches the hinge (10') to the doorframe (51) and has multiple holes and multiple fasteners.

The body (22) is attached to the doorframe mount (21) and has a spindle positioning hole (221), a transverse hole (222) and two threaded mounting holes. The spindle positioning hole (221) is formed longitudinally through the body (22). The transverse hole (222) communicates with the spindle positioning hole (221) and faces the doorframe mount (21). The threaded mounting holes correspond to two through holes in the doorframe mount (21).

The spindle (24) is mounted rotatably in the spindle positioning hole (221) and has an exterior surface, an upper end (241), a lower end (242), a positioning flat (243) and two adjusting flats (244). The positioning flat (243) is defined in the exterior surface in the spindle positioning hole (221) and is aligned with the transverse hole (222). The upper and the lower ends (241, 242) extend respectively out of the spindle positioning hole (221). The adjusting flats (244) are defined in the exterior surface respectively at the upper and the lower ends (241, 242) that protrude out of the spindle positioning hole (221).

The positioning device (23) is mounted in the body (22) and comprises an activating assembly (231). The activating assembly (231) comprises two resilient elements (233) and an sliding plug (232). The sliding plug (232) is mounted slidably in the transverse hole (222) and presses against the positioning flat (243) on the spindle (24). The resilient elements (233) can be springs, are mounted in the transverse hole (222) between the sliding plug (232) and the doorframe mount (21) to press the sliding plug (232) against the positioning flat (243).

The door bracket (25) is attached to the glass panel (51) and comprises a male bracket (251) and a female bracket (252). The male and the female brackets (251, 252) are U-shaped and are attached together to form the door bracket (25) to hold the glass panel (51). The male bracket (251) has a U-shaped primary protrusion (253). The primary protrusion (253) has two secondary protrusions (254), two spindle alignment holes (255) and two pairs of threaded adjustment holes (256). The secondary protrusions (254) correspond respectively to the upper and the lower ends (241, 242) of the spindle (24). The spindle alignment holes (255) align with the spindle positioning hole (221) in the body (22) and the adjusting flats (244) on the spindle (24) and rotatably hold the upper and the lower ends (241, 242) of the spindle (24). The pairs of threaded adjustment holes (256) are respectively defined completely through the secondary protrusions (254), communicate respectively with the corresponding spindle alignment holes (255) and are aligned respectively with the adjusting flats (244) on the spindle (24).

The female bracket (252) is attached to the male bracket (251), and the glass panel (51) is held between the two brackets (251, 252). The female bracket (252) has two recesses (257) and two pairs of through holes (258). The recesses (257) face, hold and engage respectively the secondary protrusions (254) to keep the two brackets (251, 252) from moving relative to each other. The pairs of through holes (258) are aligned respectively with the pairs of threaded adjustment holes (256) in the male bracket (251).

The adjusting screws (26) extend respectively through the through holes (258) in the female bracket (252) and screw respectively into the threaded adjustment holes (256) in the male bracket (251). Each of the adjusting screws (26) has an inside end (261) and an outside end (262). The outside end (262) of each adjusting screw (26) can have a hexagonal driving recess (263) so that the adjusting screws (26) can be driven into or retracted from the threaded adjustment holes (256) with an Allen wrench (not shown). The inside ends (261) press against the adjusting flats (244) on the spindle (24).

Figure 9:
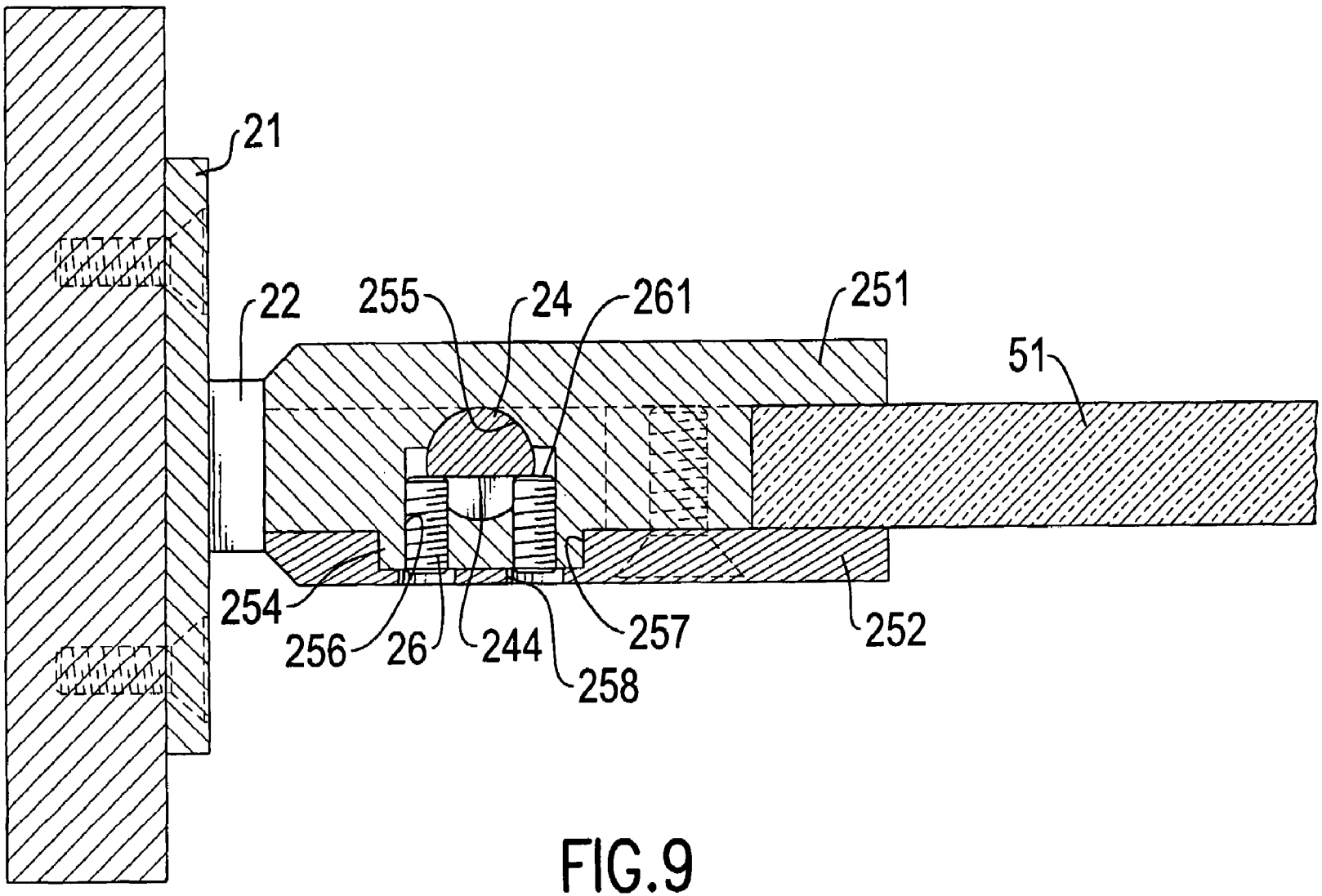
FIG. 9 is a top view in partial section of the adjustable hinge along line 9—9 in FIG. 8.
Figure 10:
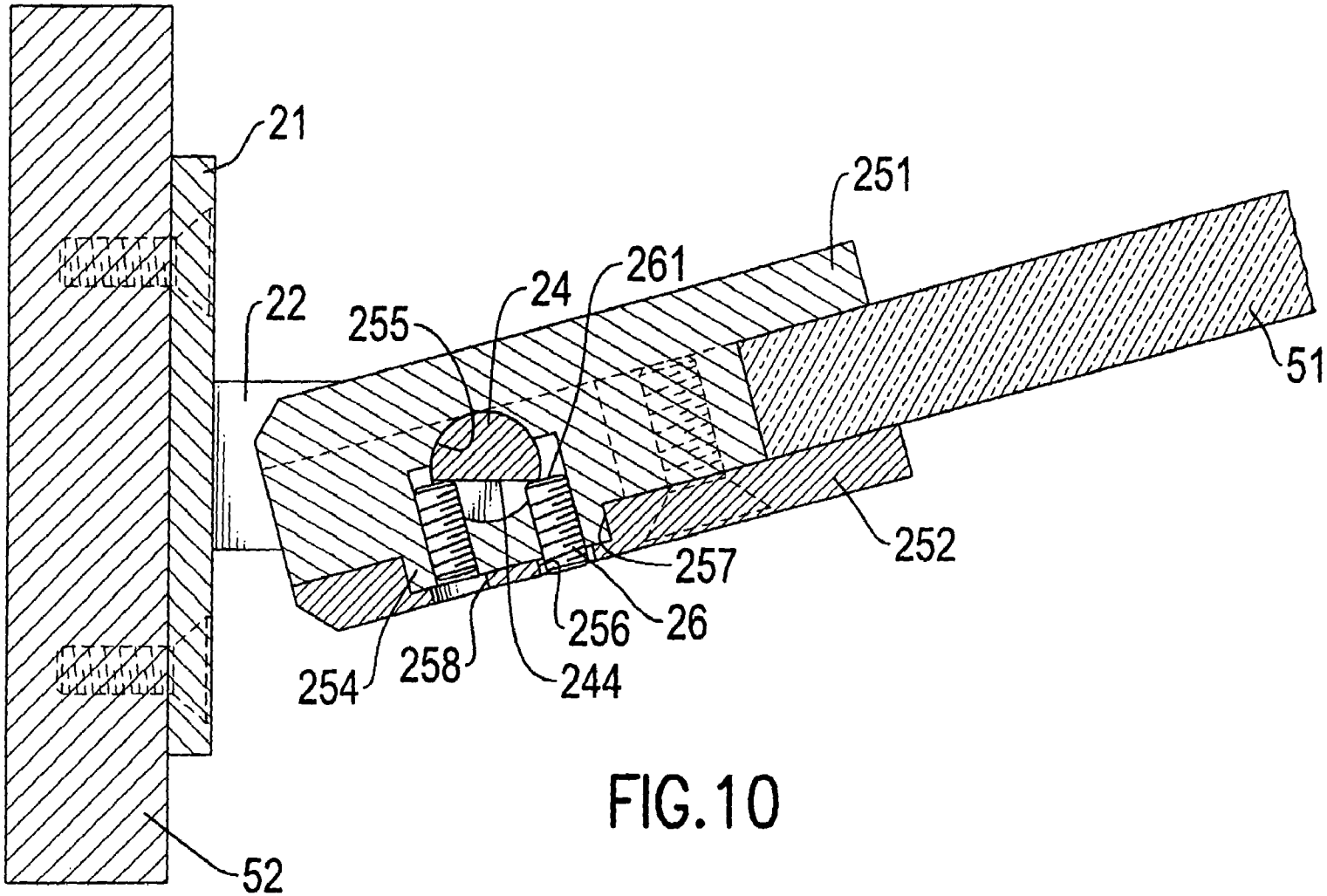
FIG. 10 is an operational top view in partial section of the adjustable hinge in FIG. 9 when a small adjustment is made to the glass panel of the glass door with the adjustable hinge.

With further reference to FIGS. 9 and 10, a detailed description of the operation of the second embodiment of the hinge (10') in accordance with the present invention is not provided since the operation of the hinge (10') is similar to the operation of the first embodiment.

The glass panel (51) does not have to be detached from the hinges (10, 10') to adjust the glass panel (51). Therefore, aligning the glass panel (51) with the doorframe (52) by adjusting the adjusting screws (16, 26) is convenient, quick and simple. In addition the glass panel (51) can be adjusted to any angle relative to the doorframe (52) when the glass panel (51) is not true. Therefore, exactly aligning the glass panel (51) with the doorframe (52) is easy to accomplish.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An adjustable automatic positioning hinge for a glass door and the adjustable hinge comprising:

a doorframe mount;

a body attached to the doorframe mount and having a spindle positioning hole defined longitudinally in the body;

a spindle being a cylinder, mounted rotatably in the spindle positioning hole and having an exterior surface; and at least one adjusting flat radially defined in the exterior surface;

a positioning device mounted in the body to position the spindle in the spindle positioning hole;

a door bracket in which the spindle is securely held, the door bracket comprising a male bracket having at least one pair of threaded adjustment holes aligned respectively with the at least one adjusting flat on the spindle; and a female bracket attached to the male bracket and having at least one pair of through holes aligned respectively with the at least one pair of threaded adjustment holes in the male bracket;

at least one pair of adjusting screws passing respectively through the at least one pair of through holes in the female bracket, screwing respectively into and held respectively in the at least one pair of threaded adjustment holes in the male bracket and having inside ends pressing against the at least one adjusting flat on the spindle.

2. The adjustable automatic positioning hinge as claimed as claimed in claim 1, wherein the body has two transverse holes defined coaxially with each other alongside and communicating with the spindle positioning hole, each of the transverse holes has an outer opening and an interior thread formed in the outer opening;

the spindle has two positioning flats aligned respectively with the transverse holes in the body; and the positioning device comprises two activating assemblies mounted respectively in the transverse holes, and each of the activating assemblies comprises a sliding plug abutting a corresponding one of the positioning flats, a threaded plug screwed into the interior thread in the respective transverse hole and a resilient element mounted between the threaded plug and the sliding plug to press the sliding plug against the corresponding positioning flat.

3. The adjustable automatic positioning hinge as claimed in claim 2, wherein the resilient elements are springs.

4. The adjustable automatic positioning hinge as claimed in claim 1, wherein the male bracket further has a primary protrusion extending toward the female bracket, and the primary protrusion has a spindle alignment hole aligned coaxially with the spindle positioning hole;

the spindle further has an outer end rotatably mounted in the spindle positioning hole and an inner end securely mounted in the spindle alignment hole; and one adjusting flat is defined in the exterior surface of the spindle and is mounted in the spindle alignment hole.

5. The adjustable automatic positioning hinge as claimed in claim 4, wherein the male bracket further has a secondary protrusion protruding from the primary protrusion toward the female bracket;

the threaded adjustment holes are defined completely through the secondary protrusion and align respectively with the inclined adjusting flats; and the female bracket further has a recess holding and engaging the secondary protrusion.

6. The adjustable automatic positioning hinge as claimed in claim 5, wherein each of the adjusting screws further has an outside end and a hexagonal driving recess defined at the outside end.

7. The adjustable automatic positioning hinge as claimed in claim 6, wherein both the male and the female brackets are U-shaped.

8. The adjustable automatic positioning hinge as claimed as claimed in claim 1, wherein the body further has a transverse hole defined and communicating with the spindle positioning hole and facing the doorframe mount;

the spindle further has a positioning flat aligned with the transverse hole in the body; and the positioning device comprises an activating assembly mounted in the transverse hole, and the activating assembly comprises a sliding plug abutting the positioning flat and a resilient element mounted between the doorframe mount and the sliding plug.

9. The adjustable automatic positioning hinge as claimed in claim 8, wherein the male bracket further has a U-shaped primary protrusion, and the primary protrusion has two spindle alignment holes aligned coaxially with the spindle positioning hole;

the spindle further has an upper end and a lower end extending out of the spindle positioning hole and securely held respectively in the spindle alignment holes; and two adjusting flats are defined in the exterior surface at the upper end of the spindle.

10. The adjustable automatic positioning hinge as claimed in claim 9, wherein the male bracket further has two secondary protrusions corresponding respectively to the spindle alignment holes and protruding respectively from the primary protrusion; and the female bracket further has two recesses respectively holding and engaging the secondary protrusions.

11. The adjustable automatic positioning hinge as claimed in claim 10, wherein the male bracket further has two pairs of threaded adjustment holes respectively defined completely through the secondary protrusions to align respectively with the adjusting flats on the spindle;

the female bracket further has four through holes aligned respectively with the threaded adjustment holes in the male bracket; and the adjustable automatic positioning hinge has four adjusting screws screwing respectively into and held respectively in the threaded adjustment holes and each of the adjusting screws in the threaded adjustment holes and has an inner end pressing against the adjusting flats on the spindle.

12. The adjustable automatic positioning hinge as claimed in claim 11, wherein each of the adjusting screw further has an outside end and a hexagonal drive recess defined at the outside end.

13. The adjustable automatic positioning hinge as claimed in claim 12, wherein both the male and the female brackets are U-shaped.

14. The adjustable automatic positioning hinge as claimed in claim 13, wherein the resilient elements are springs.

* * * * *